United States Patent [19]

Holst et al.

[11] 4,336,299

[45] Jun. 22, 1982

[54] USE OF MODIFIED CELLULOSE HYDRATE FIBERS IN THE MANUFACTURE OF BONDED NON-WOVEN FABRICS AND PRODUCTS PREPARED IN THIS MANNER

[75] Inventors: Arno Holst, Wiesbaden; Reinhart Mayer, Kelheim; Wilhelm Fischer, Pirmasens, all of Fed. Rep. of Germany

[73] Assignee: Hoechst Aktiengesellschaft, Fed. Rep. of Germany

[21] Appl. No.: 50,148

[22] Filed: Jun. 20, 1979

[30] Foreign Application Priority Data

Jun. 24, 1978 [DE] Fed. Rep. of Germany ..... 2827804

[51] Int. Cl.[3] ..... D04H 1/58; D04H 1/48; D04H 5/04

[52] U.S. Cl. ..... 428/288; 264/122; 264/128; 428/536; 428/904; 523/205; 523/200; 524/35

[58] Field of Search ..... 428/288, 290, 536, 375, 428/378, 393, 913, 904; 264/188, 122

[56] References Cited

U.S. PATENT DOCUMENTS

| | | | |
|---|---|---|---|
| 3,785,918 | 1/1974 | Kavai et al. | 264/188 |
| 3,844,287 | 10/1974 | Smith | 260/17.4 CL |
| 3,872,196 | 3/1975 | Bridgeford | 264/188 |
| 4,063,558 | 12/1977 | Smith | 428/913 |
| 4,066,584 | 1/1978 | Allen et al. | 264/191 |
| 4,104,214 | 8/1978 | Meierhoefer | 264/188 |
| 4,136,697 | 1/1979 | Smith | 264/194 |
| 4,169,121 | 8/1979 | Pietsch et al. | 264/103 |
| 4,187,342 | 2/1980 | Holst et al. | 428/288 |

*Primary Examiner*—James J. Bell
*Attorney, Agent, or Firm*—James E. Bryan

[57] ABSTRACT

This invention relates to a bonded non-woven fabric capable of absorbing water vapor, containing fibers of cellulose hydrate modified by at least one organic polymeric compound, either solely or blended with synthetic, natural or regenerated fibers.

6 Claims, No Drawings

USE OF MODIFIED CELLULOSE HYDRATE FIBERS IN THE MANUFACTURE OF BONDED NON-WOVEN FABRICS AND PRODUCTS PREPARED IN THIS MANNER

The present invention relates to the use of fibers of modified cellulose hydrate in the manufacture of bonded non-woven fabrics which are capable of absorbing water vapor and to products prepared in this manner.

Bonded non-woven fabrics, i.e. non-woven fabrics bonded by chemical binders are of interest for various technical applications, which include their use as substitutes, particularly for leather or certain textiles which are, for example, employed in the manufacture of shoes (shoe upper materials, linings and soles), bag goods, upholstery covers, outer garments ("leather" and all-weather garments) or for textiles and articles for domestic use (tablecloths, window "leathers", wiping cloths). They are, however, also used in combination with or as complements to the materials (e.g. leather or textiles) which may be employed in these fields, apart from the non-woven fabrics. The use of bonded non-woven fabrics in these fields has been known for some time.

The preparation of fibers from modified cellulose hydrate is known; the following publications are pertinent in this connection:

DE-OS No. 2,638,654 discloses the preparation of a viscose spinning solution by dissolving cellulose xanthogenate in an aqueous soda lye and allowing the solution to ripen, then 5 to 20% by weight of a water-soluble sodium carboxymethylcellulose are added to the spinning solution and the thus modified solution is spun into an acid bath; the filaments produced are finally purified, if desired partially cross-linked, and dried;

DE-OS No. 2,634,994 discloses cellulose fibers having an acrylic polymer imbedded therein, which are prepared in such a way that the cellulose fibers are regenerated from a viscose solution to which a copolymer of acrylic acid and methacrylic acid has been admixed in a quantity of 2 to 30% by weight, relative to the weight of the cellulose in the viscose solution;

DE-AS No. 2,324,589 describes dry alkaline blended fibers which are prepared by mixing a preponderant amount of a fiber-forming viscose with the alkali salt of a polyacrylic acid; the mixture is then shaped into fibers, the fibers are coagulated and regenerated, and dried in the alkaline condition (see also published French Patent Application 22 16 387); and U.S. Pat. No. 4,063,558 describes fibers composed of a matrix of regenerated cellulose containing an alkali metal salt of alginic acid, finely dispersed within this matrix.

It is an object of the present invention to provide a use for cellulose hydrate fibers modified in this manner, in which the characteristic properties of these fibers can be utilized.

According to the invention, this object is achieved by using fibers of cellulose hydrate modified by an organic polymeric compound in the manufacture of bonded non-woven fabrics which are capable of absorbing water vapor, either solely or blended with synthetic, natural or regenerated fibers.

The manufacture of bonded non-woven fabrics is described in DE-OS No. 2,710,874. Methods for manufacturing non-woven fabrics include the preparation of carded webs, webs obtained by a pneumatic route, spun webs or webs which are manufactured by wet laying, for example, on a paper-making machine. The basic constituents of the non-woven fabrics according to the invention may be synthetic, natural or regenerated fibers, in particular fibers of polyester, polyamide, polyacrylonitrile, polyvinyl chloride, polyvinyl acetate, polyvinyl alcohol, cotton, staple rayon, collagen, regenerated cellulose, polyurethane or mixtures thereof. The fibers of modified cellulose hydrate are added to these fibers before or during the manufacture of the non-woven fabric and are uniformly incorporated therein. It is also possible to use the fibers of modified cellulose only, when manufacturing the non-woven fabric. The bonding of the fibers or of the fiber mixtures can, for example, be carried out by dip-impregnating or by treating on a matrix. As binders, synthetic latex, polyurethane, or polyurethane precursors or polyacrylates are used in most cases. Further details may be found in the above-mentioned DE-OS No. 2,710,874.

Fibers which are particularly suitable for use according to the present invention are those, during the preparation of which the modifying agent is added to the viscose or to a stage comparable therewith, prior to shaping (regenerating) into fibers. If this modifying agent is soluble in water and alkali, it is added just shortly before the spinneret; if, on the other hand, the modifying agent is insoluble in water and alkali, it is already added prior to xanthogenation of the cellulose. The modifying agents used are preferably organic polymers, for example, natural or synthetic polysaccharides or polysaccharide derivatives which are soluble in water and/or alkali or insoluble in water and/or alkali and have a base of starch, cellulose, guar, alginic acid and alginates, galactomannans, arabinogalactans or pectins (cf. for example A. A. Lawrence "Edible Gums and Related Substances", Noyes Data Corp., Park Ridge, N.J., 1973); cellulose ethers, such as CMC, HEC, MC, EC or the mixed ethers thereof, corresponding starch ethers or guar ethers and alginates; acrylic polymers, methacrylic polymers or the mixed polymers thereof, particularly polyacrylic acid, polymethacrylic acid, partially hydrolyzed polyacrylamides, partially hydrolyzed polyacrylonitriles or the corresponding salts are used in particular.

If the bonded non-woven fabrics according to the invention are to be employed, in particular, in the shoe industry, for example, as a carrier material for synthetic uppers, the coating can be effected in one working step together with the bonding of the web—in particular by the process which has been described above of applying the coating agent and/or binder to a matrix—or the fabric can be coated after it already has been bonded; such coating processes are generally known and are described, for example, in Kunststoffhandbuch (Plastics Handbook), Volume VII, "Polyurethane", by R. Vieweg and A. Höchtlen, Carl Hanser Verlag, Munich (1966) or Volume II, parts 1 and 2, "Polyvinyl chloride" by K. Krekeler and G. Wick, Carl Hanser Verlag, Munich, 1963.

Non-woven fabrics constructed according to the invention have a high capacity for the absorption of water vapor and the transmission of water vapor, which exceeds a mere transport effect of the incorporated fibers of modified cellulose hydrate. Furthermore, they are also able to release the absorbed water vapor again under certain conditions, for example, when placed under different climatic conditions.

Because the properties of the bonded non-woven fabrics are not alone the result of the significantly detectable effect of the addition of the fibers of modified cellulose hydrate, but also depend, inter alia, on the thickness of the non-woven fabric, the latter are advantageously prepared in a thickness of about 0.1 to 5 mm or are split to this thickness.

The bonded non-woven fabrics according to the invention, having the aforementioned properties, are suitable, for example, for use as self-supporting webs (for example as shoe linings or insoles) or as carriers for coatings of synthetic materials for use as shoe upper material, upholstery covers, bag goods and outer garments ("leather" garments and all-weather garments), and in particular as carriers for coatings to produce synthetic leather.

The parameters used in the following examples for characterizing the non-woven fabrics of the invention are to be understood as meaning the following:

WDA

The water vapor absorption is determined as the weight loss of a sample dried to constant weight, relative to the original weight, under the conditions according to DIN No. 53 304 (May 1968 edition) at 102° C.±2° C. In this method, the sample is first weighed, in the state as delivered, to an accuracy of 0.001 g, immediately after it has been taken out of a water vapor-tight container. The test specimens are then dried, suspended in a heating cabinet, at 102° C.±2° C. for 15 hours and, after cooling to room temperature, are again weighed to an accuracy of 0.001 g. In order to be able thoroughly to test the capacity of the samples for the absorption of water vapor under different conditions, the particular samples are suspended under different climatic conditions and these samples are taken out after certain time intervals and their absorption of water vapor is then determined in % by weight, relative to their initial weight at the start of the particular measurement.

The percentages given denote % by weight.

EXAMPLE 1

80 g of the sodium salt of polyacrylic acid are dissolved in 1 liter of a 5% concentration aqueous NaOH solution and are introduced before the spinneret into the viscose-bearing conduit of a manufacturing equipment for cellulose hydrate fibers via a metering pump. The thus modified viscose is spun in the usual way and is further processed. The parts by weight of cellulose hydrate and of sodium salt of polyacrylic acid have the same relationship as 2.33:1.

15% of these modified cellulose hydrate fibers (3.6 dtex, length 30 mm) are willowed together with 85% of polyester fibers (1.7 dtex, length 40 mm) and passed through a mixing chamber, the mixture is then carded and needled and the resulting web is bonded with a ®Perbunan Latex in such a manner that the percentage of binder in the bonded non-woven fabric amounts to about 50%.

EXAMPLE 2

The procedure is the same as in Example 1, except that 90 g of a partially saponified polyacrylonitrile are used as the modifying agent and the proportion by weight of the cellulose hydrate relative to the modifying agent corresponds to 7.33:1.

EXAMPLE 3

The procedure is the same as in Example 1, except that 100 g of the sodium salt of carboxymethylcellulose are used as the modifying agent and the proportion by weight of the cellulose hydrate relative to the modifying agent corresponds to 3.17:1.

EXAMPLE 4

The procedure is the same as in Example 1, except that 25% of the modified cellulose hydrate fibers and 75% of the polyester fibers are used.

EXAMPLE 5

The procedure is the same as in Example 2, except that 25% of the modified cellulose hydrate fibers and 75% of the polyester fibers are used.

EXAMPLE 6

The modified cellulose hydrate fibers prepared as specified in Example 1 are bonded with an unmodified fiber without any previous mixing.

In the table below, the absorption capacity for water vapor of the bonded non-woven fabrics of Examples 1 through 6 is compared with the absorption capacity for water vapor of a bonded non-woven fabric (100% polyester fibers, 1.7 dtex, length 40 mm) which does not contain any modified cellulose hydrate fibers (Comparison Example VI). The parameter $WDA_{95}$ has the following significance: Starting from a relative humidity of 50% the sample is, at a temperature of 23° C., exposed during a certain period of time (4 or 8 hours) to a relative humidity of 95%; correspondingly, $WDA_{91}$ designates a relative humidity of 91%.

TABLE

| Example | Thickness of non-woven fabric (mm) | Dimensions of sample ($mm^2$) | Absorption of water vapor Time (hours) | $WDA_{95}$ (%) | $WDA_{91}$ (%) |
|---|---|---|---|---|---|
| V1 | 1.2 | 50 × 100 | 4 | 0.84 | 0.70 |
| | | | 8 | 1.01 | 0.85 |
| 1 | " | " | 4 | 3.26 | 2.49 |
| | | | 8 | 3.32 | 2.74 |
| 2 | " | " | 4 | 3.07 | 2.30 |
| | | | 8 | 3.12 | 2.62 |
| 3 | " | " | 4 | 3.14 | 2.35 |
| | | | 8 | 3.23 | 2.66 |
| 4 | " | " | 4 | 4.19 | 2.79 |
| | | | 8 | 4.29 | 2.91 |
| 5 | " | " | 4 | 3.73 | 2.75 |
| | | | 8 | 3.86 | 2.85 |
| 6 | " | " | 4 | 15.40 | 11.60 |
| | | | 8 | 17.50 | 13.00 |

It will be obvious to those skilled in the art that many modifications may be made within the scope of the present invention without departing from the spirit thereof, and the invention includes all such modifications.

What is claimed is:

1. A bonded non-woven fabric bonded by a chemical binder and capable of absorbing water vapor, containing fibers of modified cellulose hydrate either solely or blended with synthetic, natural or regenerated fibers, said modified cellulose hydrate being prepared prior to shaping into fibers by adding to viscose a modifying agent selected from the group consisting of a polysaccharide, a polysaccharide derivative, an acrylic polymer and a methacrylic polymer.

2. A non-woven fabric according to claim 1 in which the modifying agent is a cellulose ether, a starch ether or a guar ether or an alginate.

3. A non-woven fabric according to claim 1 in which the modifying agent is a polyacrylic acid, a polymethacrylic acid, a partially hydrolyzed polyacrylamide, a partially hydrolyzed polyacrylonitrile or a corresponding salt.

4. A bonded non-woven fabric bonded by a chemical binder selected from the group consisting of synthetic latex, polyurethane, polurethane precursors and polyacrylates capable of absorbing water vapor, containing fibers of modified cellulose hydrate either solely or blended with synthetic, natural or regenerated fibers, said modified cellulose hydrate being prepared prior to shaping into fibers by adding to viscose a modifying agent selected from the group consisting of a polysaccharide, a polysaccharide derivative, an acrylic polymer and a methacrylic polymer.

5. A process of manufacturing a bonded non-woven fabric comprising (a) adding and incorporating fibers of modified cellulose hydrate into synthetic, natural or regenerated fibers before or during the manufacture of the non-bonded non-woven fabric, said modified cellulose hydrate being prepared prior to shaping into fibers by adding to viscose a modifying agent selected from the group consisting of a polysaccharide, a polysaccharide derivative, an acrylic polymer and a methacrylic polymer, and (b) bonding the fiber mixture by a chemical binder.

6. A process of manufacturing a bonded non-woven fabric comprising bonding fibers of modified cellulose hydrate with a chemical binder, said modified cellulose hydrate being prepared prior to shaping into fibers by adding to viscose a modifying agent selected from the group consisting of a polysaccharide, a polysaccharide derivative, an acrylic polymer and a methacrylic polymer.

* * * * *